US011767969B2

(12) United States Patent
Smyth et al.

(10) Patent No.: US 11,767,969 B2
(45) **Date of Patent: *Sep. 26, 2023**

(54) SYSTEM, METHOD AND APPARATUS FOR DECORATIVE ASSEMBLY

(71) Applicant: Tulip Home Goods, LLC, Austin, TX (US)

(72) Inventors: Lori Smyth, Austin, TX (US); Paul van der Grient, Austin, TX (US)

(73) Assignee: TULIP HOME GOODS, LLC, Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/969,263

(22) Filed: Oct. 19, 2022

(65) Prior Publication Data

US 2023/0243487 A1 Aug. 3, 2023

Related U.S. Application Data

(63) Continuation of application No. 17/738,471, filed on May 6, 2022, now Pat. No. 11,486,563.

(60) Provisional application No. 63/305,452, filed on Feb. 1, 2022.

(51) Int. Cl.

| | |
|---|---|
| ***F21V 17/10*** | (2006.01) |
| ***F21V 1/18*** | (2006.01) |
| ***F21V 1/12*** | (2006.01) |
| ***F21V 1/04*** | (2006.01) |

(52) U.S. Cl.

CPC ..... *F21V 17/105* (2013.01); *F21V 1/04* (2013.01); *F21V 1/12* (2013.01); *F21V 1/18* (2013.01); *F21V 17/101* (2013.01)

(58) Field of Classification Search

CPC ..... F21V 17/105; F21V 17/101; F21V 1/12; F21V 1/18; F21V 1/02; F21V 1/04

USPC ..... 362/351, 355, 356, 357, 358, 361, 398, 362/147, 404, 408

See application file for complete search history.

(56) References Cited

U.S. PATENT DOCUMENTS

| | | | | |
|---|---|---|---|---|
| 4,344,114 | A | 8/1982 | Denhart | |
| 8,393,762 | B2 * | 3/2013 | Wu | F21V 17/007 362/358 |
| 11,486,563 | B1 * | 11/2022 | Smyth | F21V 17/101 |
| 2006/0239011 | A1 * | 10/2006 | Bin | F21V 1/06 362/357 |
| 2009/0103314 | A1 * | 4/2009 | Hammer | F21V 17/105 362/351 |
| 2012/0206925 | A1 | 8/2012 | Shenk et al. | |
| 2017/0097145 | A1 * | 4/2017 | Friz | F21V 1/143 |
| 2017/0299155 | A1 * | 10/2017 | Bibi | F21V 1/20 |

(Continued)

FOREIGN PATENT DOCUMENTS

| | | |
|---|---|---|
| CN | 105889825 A | 8/2016 |
| CN | 206488161 U | 9/2017 |

(Continued)

*Primary Examiner* — Laura K Tso

(74) *Attorney, Agent, or Firm* — Dickinson Wright PLLC

(57) ABSTRACT

A fixture can include a frame having a central portion that is open and unobstructed. Magnets can be coupled to the frame. An adhesive can be configured to bond the frame to a surface. A decoration can have a metal frame that is configured to detachably couple to the magnets of the frame. The decoration can detachably extend from the frame and the surface, such that it is secured to the frame only by magnetic force.

17 Claims, 7 Drawing Sheets

(56) References Cited

U.S. PATENT DOCUMENTS

| | | | |
|---|---|---|---|
| 2018/0347782 | A1 | 12/2018 | Brantley |
| 2021/0080074 | A1 | 3/2021 | Chen |

FOREIGN PATENT DOCUMENTS

| | | | |
|---|---|---|---|
| CN | 208332014 | U | 1/2019 |
| CN | 209977730 | U | 1/2020 |
| CN | 210441050 | U | 5/2020 |
| KR | 200378270 | Y1 | 3/2005 |
| KR | 101393377 | B1 | 5/2014 |

* cited by examiner

SYSTEM, METHOD AND APPARATUS FOR DECORATIVE ASSEMBLY

CROSS-REFERENCE TO RELATED APPLICATION

This application is a continuation of and claims priority to and the benefit of U.S. patent application Ser. No. 17/738,471, filed May 6, 2022, which claims priority to and the benefit of U.S. Prov. Pat. App. No. 63/305,452, filed Feb. 1, 2022, both of which are incorporated herein by reference in their entirety.

TECHNICAL FIELD

This application generally relates to ornamental assemblies and, in particular, to a system, method and apparatus for a decorative assembly.

BACKGROUND

There are many types of decorative assemblies for home furnishings, such as light fixtures. Over time, light fixtures can become outdated, less desirable or can be less than ideal for some forms of home entertainment. In other situations, it can be desirable to enhance or decorate an open space on a surface (e.g., a wall, ceiling, etc.) in a dwelling or business. Adding, updating and/or replacing ornamentations, such as light fixtures, can be costly and laborious. Thus, improvements in decorative assemblies continue to be of interest.

SUMMARY

Embodiments of a system, method and apparatus for a fixture can include a frame having a central portion that is open and unobstructed. Magnets can be coupled to the frame. An adhesive can be configured to bond the frame to a surface. A decoration can have a metal frame that is configured to detachably couple to the magnets of the frame. The decoration can detachably extend from the frame and the surface.

DETAILED DESCRIPTION

Figure 1A:
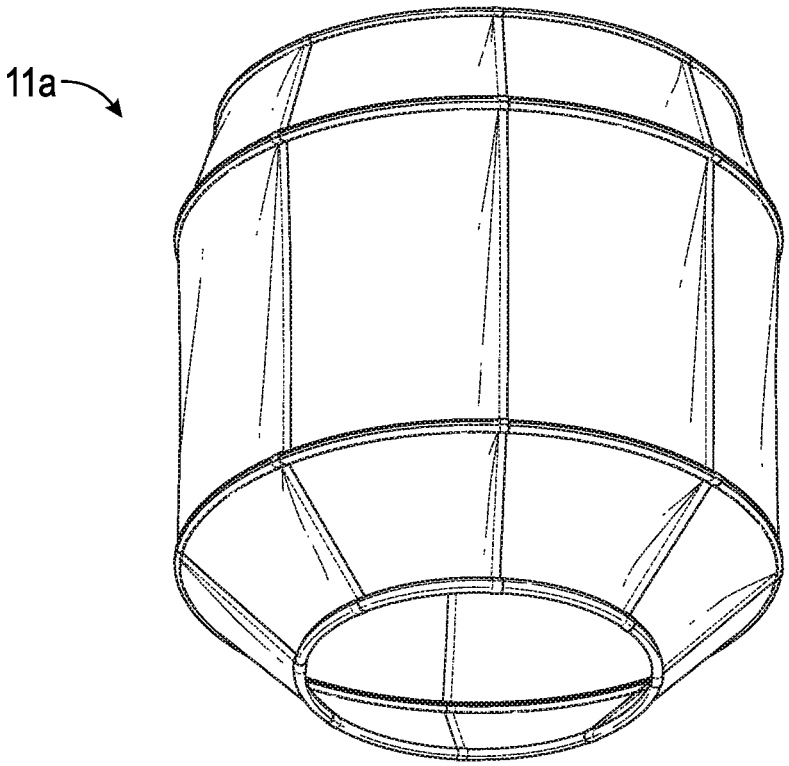
FIGS. 1A-1D depict bottom isometric views of four examples of fixtures.
Figure 1B:
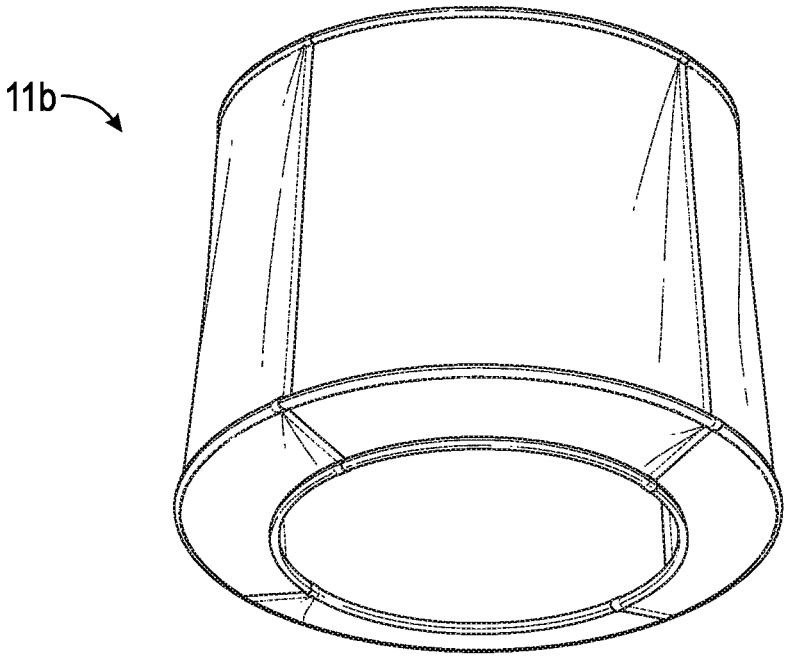
Figure 1C:
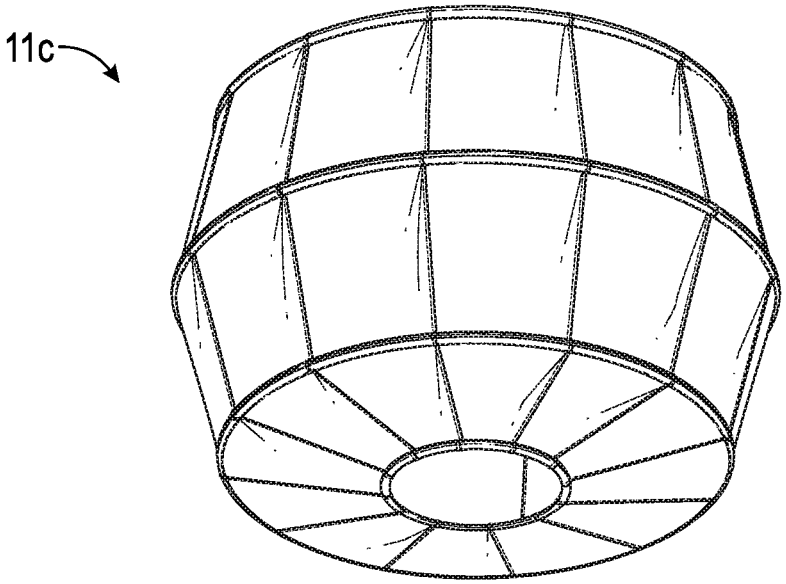
Figure 1D:
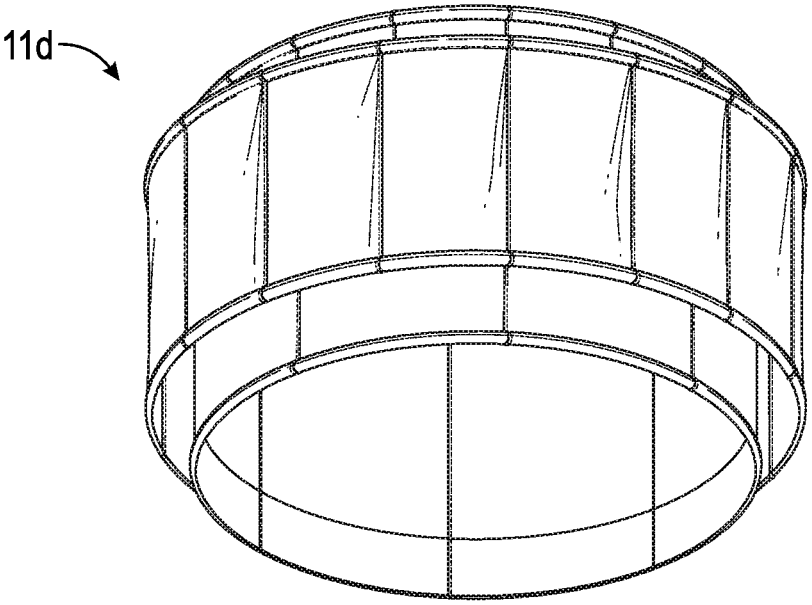
Figure 2:
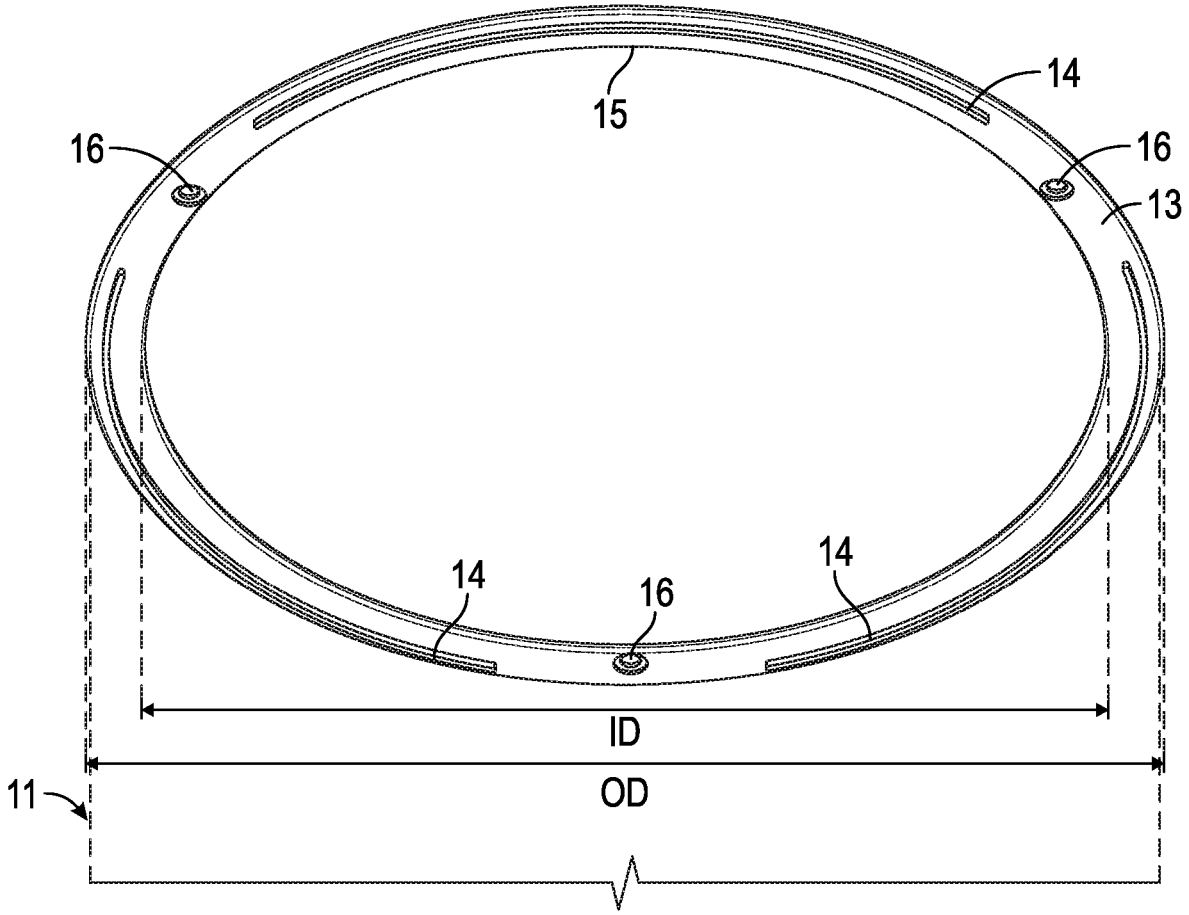
FIG. 2 is a bottom isometric view of an embodiment of a fixture including a mounting ring and light shade.

FIGS. 1-8 depict various embodiments of decorations and ornamentations. For example, four examples of a fixture 11*a*, 11*b*, 11*c* and 11*d* are shown in FIG. 1. As shown in FIG. 2, the fixture 11 can include a ring or frame 13. One example of the frame 13 can comprise a rigid polymer. The frame 13 can have a central portion 15 that is, in an example, open and unobstructed. In some embodiments, the frame 13 can have an outer diameter OD and the central portion 15 can have an inner diameter ID that is at least about 75%, or at least about 80%, of the outer diameter OD.

Figure 3:
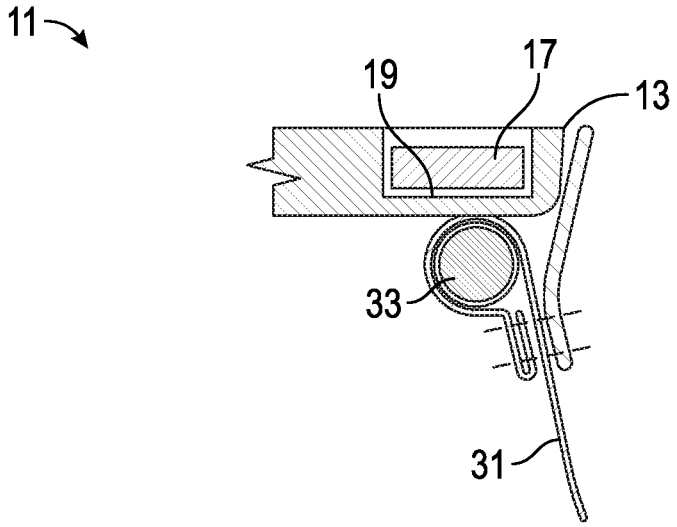
FIG. 3 is a sectional side view of an upper portion of the embodiment of FIG. 2.
Figure 4:
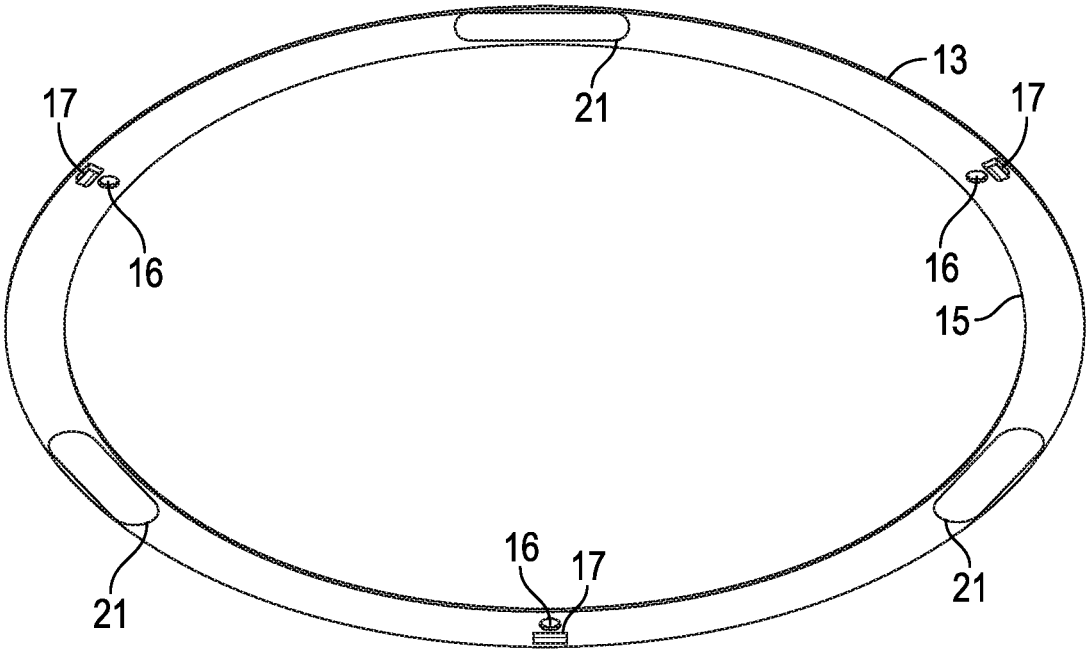
FIG. 4 is a top isometric view of an embodiment of the mounting ring of FIG. 2.
Figure 5:
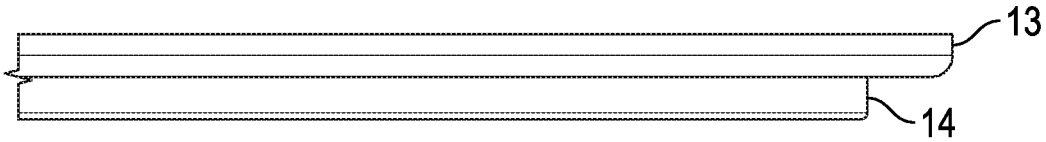
FIG. 5 is a side view of a portion of an embodiment of the mounting ring.

As shown in FIGS. 3-4, the frame 13 also can include magnets 17 that can be coupled to the frame 13. The magnets 17 can be located and secured (such as by bonding) in respective recesses 19 in the frame 13.

In addition, an adhesive 21 can be coupled to the frame 13. The adhesive 21 can be configured to bond the frame 13 to a surface, such as to a wall or a ceiling of a structure. Versions of the adhesive 21 can comprise strips of adhesive 21 (see FIG. 4) that are bonded to the frame 13. For example, each strip of adhesive 21 can comprise a release liner (not shown) that is configured to be removed prior to securing the strips of adhesive 21 to the surface on which fixture 11 will be mounted.

Embodiments of the frame 13 can include a downward extending rim 14. The downward extending rim 14 can be segmented, as shown by the three segments of rim 14 in FIG. 2. Optionally, versions of the frame 13 also can include apertures 16 for fasteners (not shown) that can be configured to extend through the apertures 16 to further secure the frame 13 to the surface.

Figure 6:
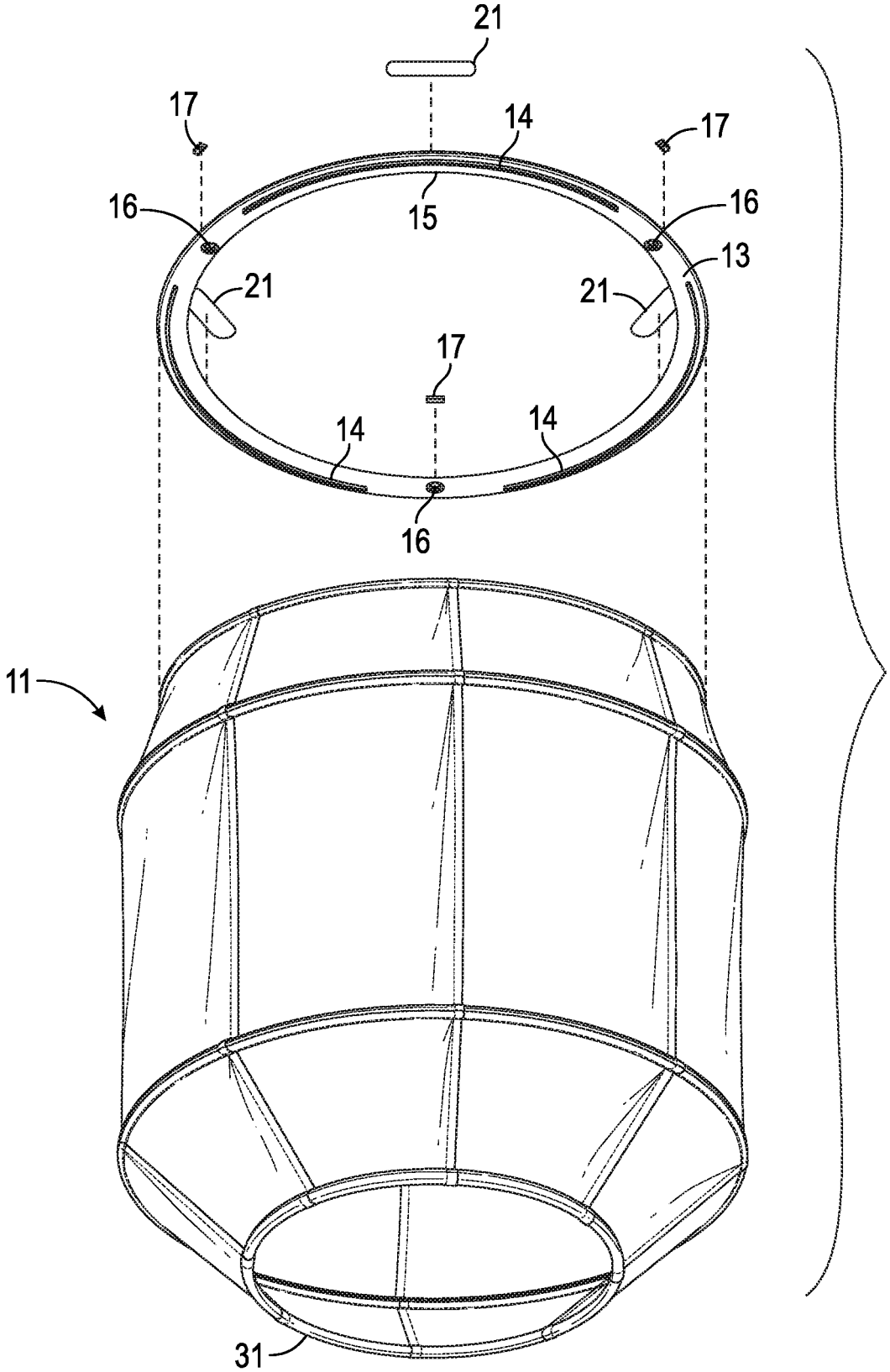
FIG. 6 is an exploded, lower isometric view of an embodiment of a fixture.

In addition, the fixture 11 can include a decoration 31 (FIGS. 3 and 6). Examples of the decoration 31 can include ornamental designs, a sculpture etc. The decoration 31 can be formed from various materials, such as fabric, paper or sewn material, or combinations thereof. Embodiments of the decoration 31 can include a metal frame 33. In one version, the metal frame 33 can be sewn into the decoration 31.

The metal frame 33 can be configured to detachably couple to the magnets 17 of the frame 13. In this way, the decoration 31 can be supported by and extend from the frame 13 and the surface to which the frame 13 is attached. In addition, the metal frame 33 of the decoration 31 can be configured to align around the downward extending rim 14 of the frame 13. During installation, this feature can help center the decoration 31 on the frame 13.

As suggested by FIG. 1, the decoration 31 can comprise various sizes and shapes, such as a lantern shape, lamp shape, gem shape or drum shape. Likewise, the frame 13 can comprise a second frame 13 or other frames 13 having a different size than the frame 13. A second decoration 31 or other decorations 31 that differ from the decoration, also can be had. The other decorations 31 can have their own, respective metal frames 33 and can be configured to be readily interchangeable with the decoration 31 on the frame 13.

Alternative embodiments of the fixture 11 can be reconfigured. For example, the fixture 11 can cover and decorate an existing light source, such as the light bulb and supporting structure of a light source, without its light shade or covering. In some examples, the light source can comprise a light fixture, lamp, recessed light or light emitting diode (LED).

Like the preceding embodiments, versions of the fixture 11 can comprise a ring 13 having an open central portion 15 that is unobstructed. Magnets 17 can be coupled to the ring 13. The ring 13 can be configured to completely circumscribe but not contact the light source in the open central portion 15. Adhesive can be configured to bond the ring 13 to a ceiling having the light source. A decoration 31, such as a light shade 31, can comprise a metal ring 33 adjacent its upper end. The metal ring 33 can be configured to detachably couple to the magnets 17 of the ring 13, such that the light shade 31 extends downward from the ring 13 and ceiling. In one example, the fixture 11 does not comprise the light source and, when assembled, no part of the fixture 11 contacts the light source. The ring 13 can comprise a rigid polymer, and the magnets 17 can be located in respective recesses 19 in the ring 13. These embodiments also may include any of the features and elements described herein.

Still other versions of the fixture 11 can include other variations. Although these versions are explicitly illustrated, one of ordinary skill in the art can readily envision the examples described below.

For example, the fixture 11 can include a metal ring 13 having an open central portion 15 that is unobstructed. The metal ring 13 can be configured to completely circumscribe but not contact the light source in the open central portion 15. Adhesive 31 can be configured to bond the metal ring 13 to a ceiling having the light source. A light shade 31 can comprise magnets 17 adjacent its upper end. The magnets 17 can be configured to detachably couple to the metal ring 13, such that the light shade 31 extends downward from the metal ring 13 and the ceiling. As before, the fixture 11 does not comprise the light source and, when assembled, no part of the fixture 11 contacts the light source.

Note that the fixture 11 can be used to cover and decorate an existing light source (e.g., a wall sconce without its light cover), or simply be attached to an open and undecorated wall or ceiling where there is no light source or any other feature. In this way, the fixture 11 can be used to decorate and otherwise undecorated surface.

Figure 7:
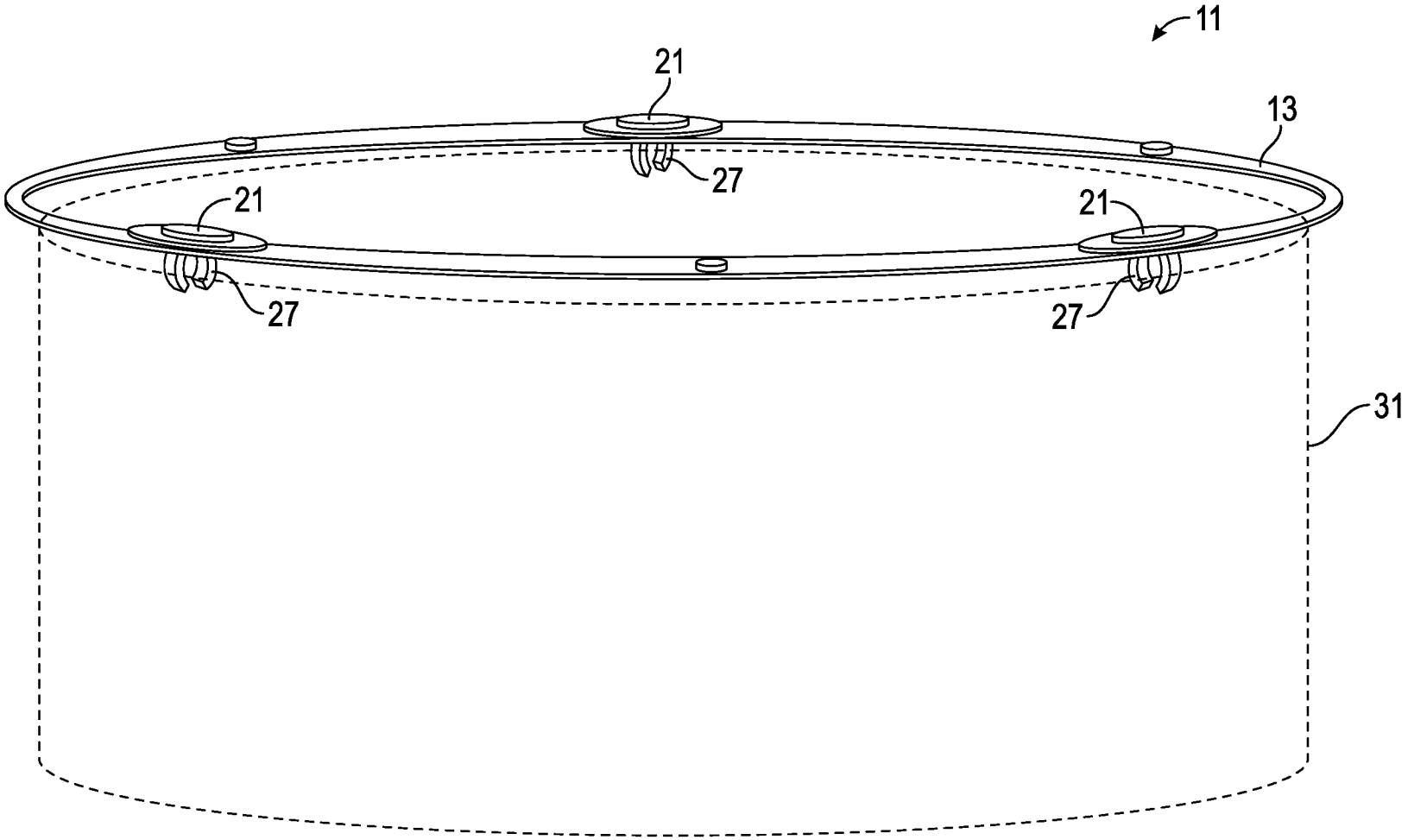
FIG. 7 is a sectional side view of an upper portion of another embodiment of a fixture.
Figure 8:
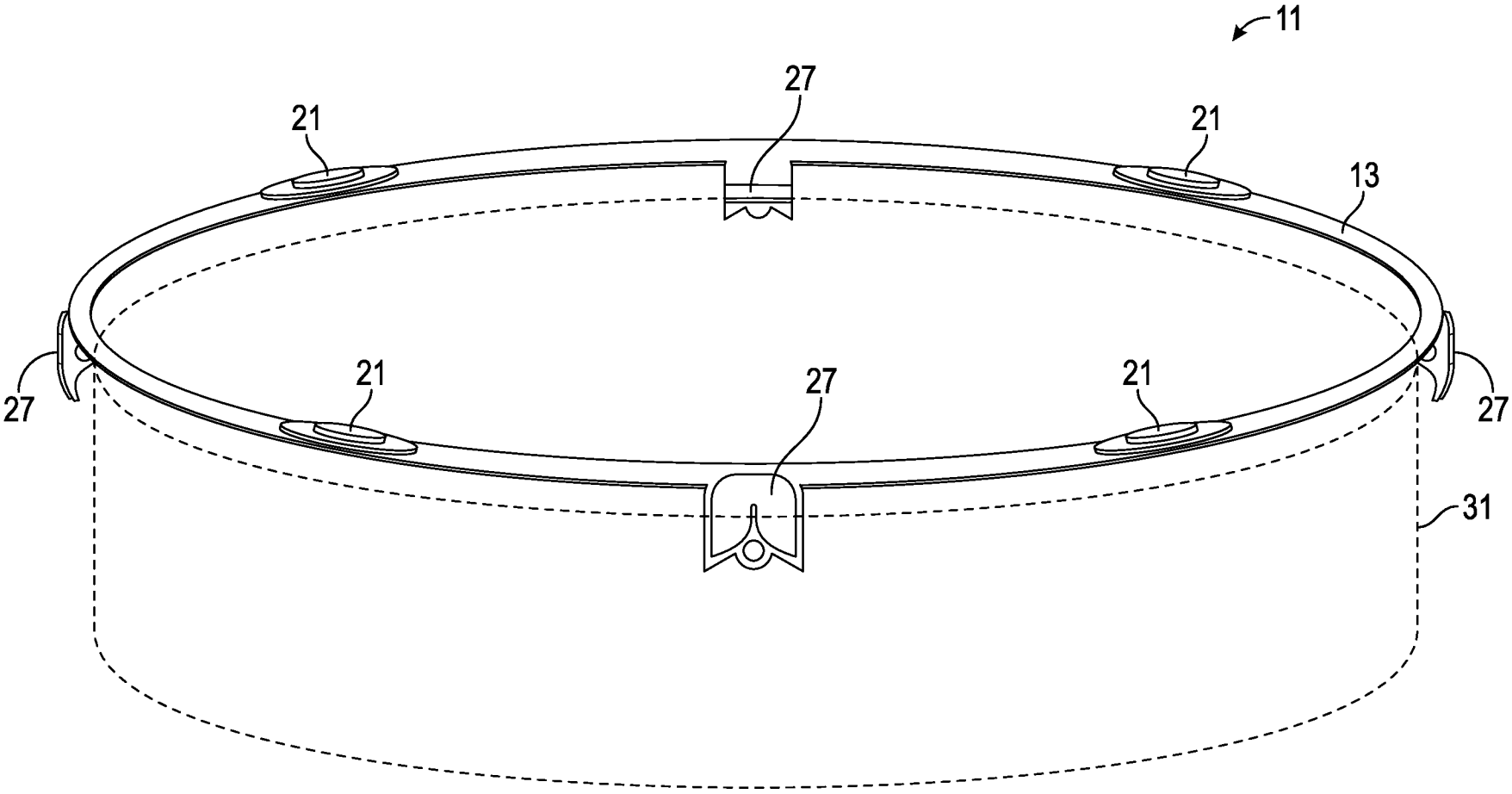
FIG. 8 is a sectional side view of an upper portion of still another embodiment of a fixture.

FIGS. 7 and 8 depict other embodiments of a fixture 11. These versions can share many, if not most of the features of the other embodiments. For example, the fixture 11 can include the frame 13 with an open central portion that is unobstructed. Adhesive 21 also can be included to bond the frame 13 to a surface, such as a ceiling or wall. A decoration 31 can include a support (not shown, but like ring 33) that is configured to detachably couple to the frame 13, such that the decoration 31 detachably extends from the frame 13 and the surface. In addition, embodiments can include clips 27 for coupling and uncoupling the decoration 31 to the frame 13. In some versions, the clips 27 are non-magnetic (or magnetic) and can comprise any type of fastener.

Other embodiments can include one or more of the following items.

1. A fixture, comprising:
   a frame having an open central portion that is unobstructed, and magnets coupled to the frame;
   adhesive configured to bond the frame to a surface; and
   a decoration comprising a metal frame, the metal frame is configured to detachably couple to the magnets of the frame, such that the decoration detachably extends from the frame and the surface, and is secured to the frame only by magnetic force.
2. The fixture wherein the decoration is ornamental or a sculpture, and comprises one of fabric, paper or sewn material, and the frame comprises a rigid polymer.
3. The fixture wherein the magnets are located in respective recesses in the frame.
4. The fixture wherein the frame comprises a downward extending rim, and the metal frame of the decoration is configured to be guided by and align around the downward extending rim.
5. The fixture wherein the frame comprises apertures and the fixture further comprises fasteners that are configured to extend through the apertures to further secure the frame to the surface.
6. The fixture wherein the frame has an outer diameter and the open central portion has an inner diameter that is at least about 80% of the outer diameter.
7. The fixture wherein the frame comprises a second frame having a different size than the frame; and further comprising:
   a second decoration that differs from the decoration, the second decoration has a second metal frame and is configured to be readily interchangeable with the decoration on the frame.

8a. The fixture wherein the metal frame is sewn into the decoration, and the decoration comprises one of a lantern shape, lamp shape, gem shape or drum shape.

8b. The fixture wherein the adhesive comprises strips that are bonded to the frame, and each strip comprises a release liner that is configured to be removed prior to securing the strips to the surface.

9. A fixture for covering and decorating a light source, the fixture comprising:
   a ring having an open central portion that is unobstructed, magnets coupled to the ring, and the ring is configured to completely circumscribe but not contact the light source in the open central portion;
   adhesive configured to bond the ring to a ceiling having the light source;
   a light shade comprising a metal ring adjacent an upper end thereof, the ring is configured to detachably couple to the magnets of the ring, such that the light shade extends downward from the ring; and
   the fixture does not comprise the light source and, when assembled, no part of the fixture contacts the light source.
10. The fixture wherein the ring comprises a rigid polymer, and the magnets are located in respective recesses in the ring.
11. The fixture wherein the ring comprises a downward extending rim, and the metal ring of the light shade is configured to be guided by and align around the downward extending rim.
12. The fixture wherein the ring comprises apertures, and the fixture further comprises fasteners that are configured to extend through the apertures to further secure the ring to the ceiling.
13. The fixture wherein the ring has an outer diameter and the open central portion has an inner diameter that is at least about 80% of the outer diameter.
14. The fixture wherein the ring comprises a second ring having a different size than the ring; and further comprising:
   a second light shade that differs from the light shade, the second light shade has a second metal ring and is configured to be readily interchangeable with the light shade on the ring.
15. The fixture wherein the light shade comprises one of fabric, paper or sewn material, and the metal ring is sewn into the light shade.
16. The fixture wherein the light shade comprises one of a lantern shape, lamp shape, gem shape or drum shape.

17a. The fixture wherein the adhesive comprises strips that are bonded to the ring and each strip comprises a release liner that is configured to be removed prior to securing the strips to the ceiling 17b. The fixture wherein the light source comprises a light fixture, lamp, recessed light or light emitting diode (LED).

18. A fixture for covering and decorating a light source, the fixture comprising:

a metal ring having an open central portion that is unobstructed, and the metal ring is configured to completely circumscribe but not contact the light source in the open central portion;

adhesive configured to bond the metal ring to a ceiling having the light source;

a light shade comprising magnets adjacent an upper end thereof, the magnets are configured to detachably couple to the metal ring, such that the light shade extends downward from the metal ring; and the fixture does not comprise the light source and, when assembled, no part of the fixture contacts the light source.

19. A fixture, comprising:

a frame having an open central portion that is unobstructed;

adhesive configured to bond the frame to a surface;

a decoration comprising a support that is configured to detachably couple to the frame, such that the decoration detachably extends from the frame and the surface; and clips for coupling and uncoupling the decoration to the frame.

20. The fixture wherein the clips are non-magnetic.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," "top", "bottom," and the like, may be used herein for ease of description to describe one element's or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated degrees or at other orientations) and the spatially relative descriptions used herein interpreted accordingly.

This written description uses examples to disclose the embodiments, including the best mode, and also to enable those of ordinary skill in the art to make and use the invention. The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

It can be advantageous to set forth definitions of certain words and phrases used throughout this patent document. The term "communicate," as well as derivatives thereof, encompasses both direct and indirect communication. The terms "include" and "comprise," as well as derivatives thereof, mean inclusion without limitation. The term "or" is inclusive, meaning and/or. The phrase "associated with," as well as derivatives thereof, can mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items can be used, and only one item in the list can be needed. For example, "at least one of: A, B, and C" includes any of the following combinations: A, B, C, A and B, A and C, B and C, and A and B and C.

Also, the use of "a" or "an" is employed to describe elements and components described herein. This is done merely for convenience and to give a general sense of the scope of the invention. This description should be read to include one or at least one and the singular also includes the plural unless it states otherwise.

The description in the present application should not be read as implying that any particular element, step, or function is an essential or critical element that must be included in the claim scope. The scope of patented subject matter is defined only by the allowed claims. Moreover, none of the claims invokes 35 U.S.C. § 112(f) with respect to any of the appended claims or claim elements unless the exact words "means for" or "step for" are explicitly used in the particular claim, followed by a participle phrase identifying a function.

Benefits, other advantages, and solutions to problems have been described above with regard to specific embodiments. However, the benefits, advantages, solutions to problems, and any feature(s) that can cause any benefit, advantage, or solution to occur or become more pronounced are not to be construed as a critical, required, sacrosanct or an essential feature of any or all the claims.

After reading the specification, skilled artisans will appreciate that certain features which are, for clarity, described herein in the context of separate embodiments, can also be provided in combination in a single embodiment. Conversely, various features that are, for brevity, described in the context of a single embodiment, can also be provided separately or in any sub-combination. Further, references to values stated in ranges include each and every value within that range.

What is claimed is:

1. A decorative assembly, comprising:

a frame having an open central portion that is unobstructed, and magnets coupled to the frame; and a decoration comprising a metal frame, the metal frame is configured to detachably couple to the magnets of the frame, such that the decoration detachably extends from the frame and a surface, and is secured to the frame only by magnetic force.

2. The decorative assembly of claim 1, wherein the decoration is ornamental or a sculpture, and comprises one of fabric, paper or sewn material, and the frame comprises a rigid polymer.

3. The decorative assembly of claim 1, wherein the magnets are located in respective recesses in the frame.

4. The decorative assembly of claim 1, wherein the frame comprises a downward extending rim, and the metal frame of the decoration is configured to be guided by and align around the downward extending rim.

5. The decorative assembly of claim 1, wherein the frame comprises apertures and the fixture further comprises fasteners that are configured to extend through the apertures to secure the frame to the surface.

6. The decorative assembly of claim 1, wherein the frame has an outer diameter and the open central portion has an inner diameter that is at least about 80% of the outer diameter.

7. The decorative assembly of claim 1, wherein the metal frame is sewn into the decoration, and the decoration comprises one of a lantern shape, lamp shape, gem shape or drum shape; and further comprising an adhesive comprises strips that are bonded to the frame, and each strip comprises a release liner that is configured to be removed prior to securing the strips to the surface.

8. A decorative assembly for covering and decorating a light fixture, the decorative assembly comprising:

a ring having an open central portion that is unobstructed, magnets coupled to the ring, and the ring is configured to completely circumscribe but not contact the light fixture in the open central portion;

a light shade comprising a metal ring adjacent an upper end thereof, the metal ring is configured to detachably couple to the magnets of the ring, such that the light shade extends downward from the ring; and the decorative assembly does not comprise the light fixture and, when assembled, no part of the decorative assembly contacts the light fixture.

9. The decorative assembly of claim 8, wherein the ring comprises a rigid polymer, and the magnets are located in respective recesses in the ring.

10. The decorative assembly of claim 8, wherein the ring comprises a downward extending rim, and the metal ring of the light shade is configured to be guided by and align around the downward extending rim.

11. The decorative assembly of claim 8, wherein the ring comprises apertures, and the fixture further comprises fasteners that are configured to extend through the apertures to secure the ring to a ceiling.

12. The decorative assembly of claim 8, wherein the ring has an outer diameter and the open central portion has an inner diameter that is at least about 80% of the outer diameter.

13. The decorative assembly of claim 8, wherein the light shade comprises one of fabric, paper or sewn material, and the metal ring is sewn into the light shade.

14. The decorative assembly of claim 8, wherein the light shade comprises one of a lantern shape, lamp shape, gem shape or drum shape.

15. The decorative assembly of claim 8, further comprising an adhesive that comprises strips that are bonded to the ring and each strip comprises a release liner that is configured to be removed prior to securing the strips to the ceiling; and the light source comprises a light fixture, lamp, recessed light or light emitting diode (LED).

16. A decorative assembly for covering and decorating a light fixture, the decorative assembly comprising:

a metal ring having an open central portion that is unobstructed, and the metal ring is configured to completely circumscribe but not contact the light fixture in the open central portion;

a light shade comprising magnets adjacent an upper end thereof, the magnets are configured to detachably couple to the metal ring, such that the light shade extends downward from the metal ring; and the decorative assembly does not comprise the light fixture and, when assembled, no part of the decorative assembly contacts the light fixture.

17. A fixture, comprising:

a frame having an open central portion that is unobstructed, and magnets coupled to the frame;

a decoration comprising a metal frame, the metal frame is configured to detachably couple to the magnets of the frame, such that the decoration detachably extends from the frame and a surface, and is secured to the frame only by magnetic force; and an adhesive comprises strips that are bonded to the frame, and each strip comprises a release liner that is configured to be removed prior to securing the strips to the surface.

* * * * *